US005179411A

United States Patent [19]

Yoshiuchi et al.

[11] Patent Number: 5,179,411

[45] Date of Patent: Jan. 12, 1993

[54] INVERSION DEVELOPMENT CONTROLLER

[75] Inventors: Katsuhiro Yoshiuchi; Akihiro Kondo; Yoshihiro Nakajima, all of Osaka, Japan

[73] Assignee: Mita Industrial Co., Ltd., Osaka, Japan

[21] Appl. No.: 754,949

[22] Filed: Sep. 4, 1991

[30] Foreign Application Priority Data

Sep. 11, 1990 [JP] Japan ..... 2-241736
Nov. 30, 1990 [JP] Japan ..... 2-337711

[51] Int. Cl.[5] ..... G03G 21/00

[52] U.S. Cl. ..... 355/208; 355/203; 355/215; 355/219; 355/246; 355/268

[58] Field of Search ..... 355/203, 204, 208, 219, 355/216, 215, 246, 268, 221, 228, 229, 67; 361/225

[56] References Cited

U.S. PATENT DOCUMENTS 3,788,739 1/1974 Coriale ..... 355/219 X
4,136,945 1/1979 Stephens ..... 355/208
4,432,634 2/1984 Tabuchi ..... 355/246
4,600,294 7/1986 Suzuki ..... 355/246
4,678,317 7/1987 Grossinger ..... 355/216
4,755,852 7/1988 Fujita ..... 355/208
4,870,460 9/1989 Harada et al. ..... 355/246
5,072,258 12/1991 Harada ..... 355/208

*Primary Examiner*—A. T. Grimley
*Assistant Examiner*—Matthew S. Smith
*Attorney, Agent, or Firm*—Cushman, Darby & Cushman

[57] ABSTRACT

An apparatus and method for inversion development control for an image forming device in which toner and carrier particles are prevented from scattering unnecessarily. Scatter prevention is performed by gradually changing both a bias voltage application to a development roller and a surface voltage application to a photosensitive drum of the image forming device. Scatter prevention is also performed by gradually changing both a bias voltage application to a development roller and an exposure light quantity that the photosensitive drum is subjected to by an exposing rod lens array of the image forming device.

11 Claims, 7 Drawing Sheets

INVERSION DEVELOPMENT CONTROLLER

BACKGROUND OF THE INVENTION

The present invention relates to an inversion development controller for use in an image forming apparatus such as a copying machine.

In a copying machine with a conventional development system using a two component developer, development has been performed by first exposing the surface of a positively charged photosensitive drum to form a latent image on the drum surface. Then negatively charged toners and positively charged carriers are made to adhere onto a non-exposed region of the latent image portion on the drum surface.

In a copying machine with an inversion development system using a two component developer, the surface of a photosensitive drum is negatively charged. In an inversion development system, negatively charged toners are made to adhere to an exposed portion of the negatively charged drum surface which has zero voltage.

The inversion development system described above is shown in prior art FIG. 1. A negative voltage of about −700 volts to about −800 volts is applied to a portion of the surface of photosensitive drum 2 by a charger 1. This creates a negatively charged portion on the surface of photosensitive drum 2.

As photosensitive drum 2 rotates, the negatively charged portion is positioned opposite exposing rod lens array 3 for exposure. Exposure creates a latent image of zero volts on the negatively charge portion of photosensitive drum 2. After exposure, photosensitive drum 2 rotates further, and the exposed negatively charged portion on the surface of photosensitive drum 2 arrives at a position opposite development roller 41. At this time, a bias voltage of about −400 volts is applied to development roller 41, causing negatively charged toners on the development roller 41 to be repulsed toward (fly) and adhere to the exposed portion of photosensitive drum 2 having zero voltage.

It is desirable that the bias voltage be applied to the development roller 41 at the same time that the exposed negatively charged portion on the surface of photosensitive drum 2 reaches the position opposite development roller 41; however, it is difficult to control such timing. When the timing is off, the bias voltage may be applied either before or after the exposed negatively charged portion has reached a position opposite development roller 41.

FIG. 2A shows a situation in which the bias voltage is applied before the exposed negatively charged portion reaches the position opposite development roller 41. The portion of photosensitive drum 2 which is positioned opposite development roller 41 has a surface voltage greater than the bias voltage of development roller 41. This causes toner particles to fly from development roller 41, and adhere to the portion of photosensitive drum 2 positioned opposite development roller 41. The voltage difference between development roller 41 and the portion of photosensitive drum 2 positioned opposite development roller 41 exceeds an allowable voltage difference range as shown in FIG. 2B. The allowable voltage difference range shown in FIG. 2B is the voltage difference range in which the bias voltage can differ from the surface voltage of the portion of photosensitive drum 2 opposite development roller 41 without causing toners or carrier particles to fly.

FIG. 3A shows the situation in which the bias voltage applied to development roller 41 is applied after the exposed negatively charged portion of photosensitive drum 2 reaches a position opposite development roller 41. The portion of photosensitive drum 2 which is opposite development roller 41 has a voltage less than the bias voltage applied to development roller 41. When this occurs, positively charged carriers are attracted onto the surface of photosensitive drum 2. As shown in FIG. 3B, the voltage difference between the bias voltage (the voltage of development roller 41) and the surface voltage of the portion of photosensitive drum 2 opposite development roller 41 exceeds the allowable voltage difference range and carriers fly.

A proposed solution to the above-mentioned problems depicted in FIGS. 2 and 3 is to gradually apply the bias voltage. This solution has the disadvantage that if the timing of the bias voltage is incorrect, the resulting voltage difference between the development roller 41 and the surface of photosensitive drum 2 opposite development roller 41 exceeds the allowable voltage difference range. However, in this situation, neither toners nor carriers adhere to the photosensitive drum; instead, the toners or carriers scatter.

SUMMARY OF INVENTION

An object of the present invention is to overcome the above-mentioned problems of the conventional and inversion development controllers. Further objectives and advantages of the present invention will be apparent from the following disclosure and drawings.

According to a first embodiment of the present invention a photosensitive body is surrounded by a charger for applying a charge or voltage to the surface of the photosensitive body, an exposure means for forming a latent image on the surface of the photosensitive body, and- a development means for developing the latent image on the photosensitive body. A surface potential control means controls the charger to gradually change the surface voltage of the photosensitive body to a first predetermined value. The exposure means then creates a latent image upon the charged portion of the photosensitive body. When the charged portion of the photosensitive body reached a position opposite the development means, a bias control means controls a bias application means to gradually change the bias voltage applied to the development means to a predetermined value. The difference between the surface voltage of the portion of the photosensitive body opposite the development means and the bias voltage of the development means falls within the allowable voltage difference range even when the timing of either the bias voltage application or surface voltage application or both is off from the norm. Therefore, toners or carriers are prevented from flying or scattering.

According to a second embodiment of the present invention the elements surrounding the first embodiment are present and a light quantity control means is provided to control the exposure light quantity of the exposure means. A charger applies a predetermined voltage to the surface of the photosensitive body. When the charged photosensitive body reaches a position opposite the exposure means, the light quantity control means controls the exposure means to gradually change the exposure light quantity from a predetermined value to zero. When the exposed portion of the charged photosensitive body reaches a position opposite the development means, a bias control means controls the bias application means to change the bias voltage applied to the development means to a predetermined value. The voltage difference between the surface voltage of the portion of the photosensitive body opposite the development means and the bias voltage of the development means falls within the allowable voltage different range even when the timing of the exposure or the application of the bias voltage or both is off from the norm. Therefore, unnecessary scattering or flying of toners and carriers is prevented.

DETAILED DESCRIPTION OF THE PREFERRED EMBODIMENTS

First Embodiment

Figure 1:
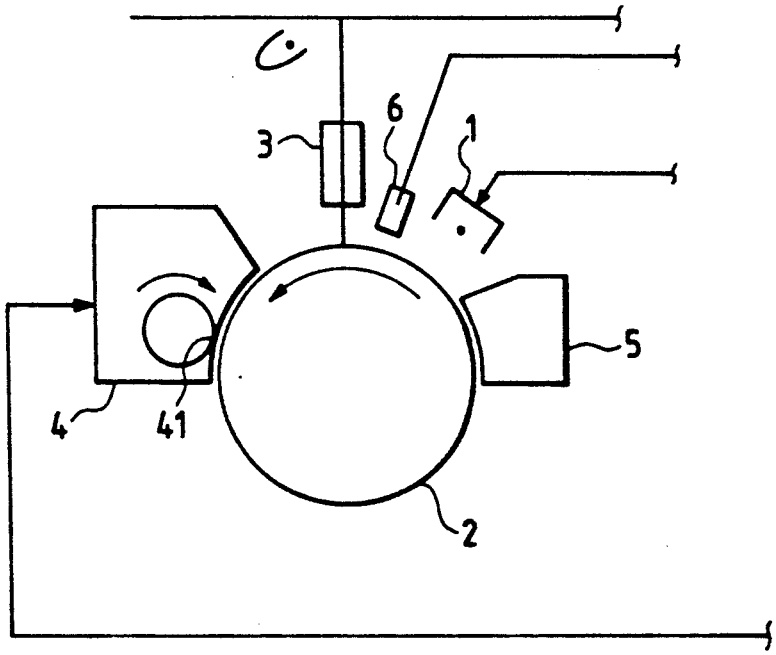
FIG. 1 PRIOR ART
FIG. 1 is a schematic sectional view showing a main part of a copying machine with a conventional inversion development system.
Figure 2A:
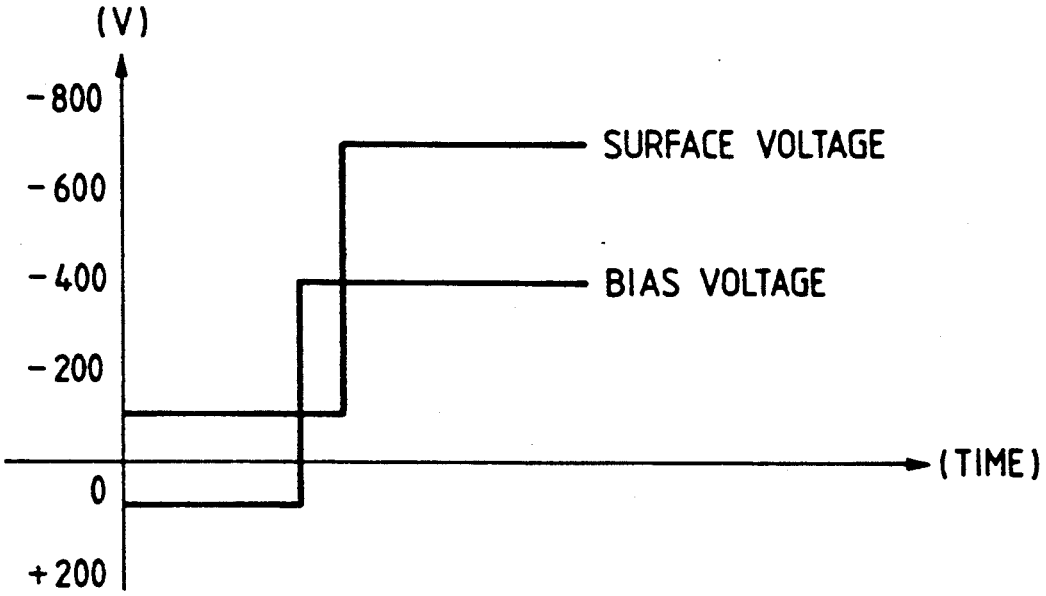
FIGS. 2A and 2B are graphs showing an example of the relationship between the surface voltage of a portion of the photosensitive drum opposite the development means and the bias voltage applied to the development means of the copying machine of FIG. 1.
Figure 2B:
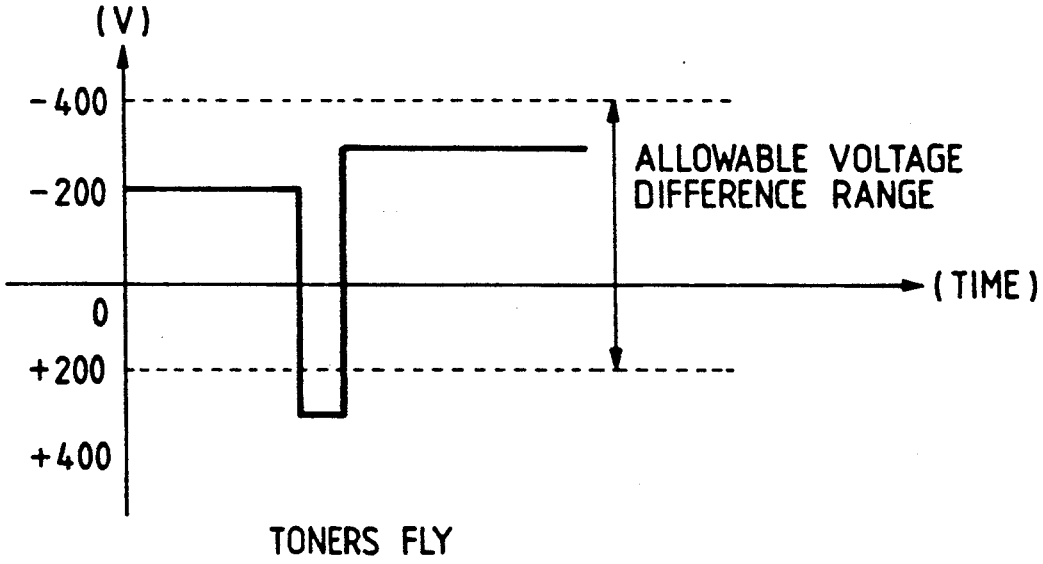
Figure 3A:
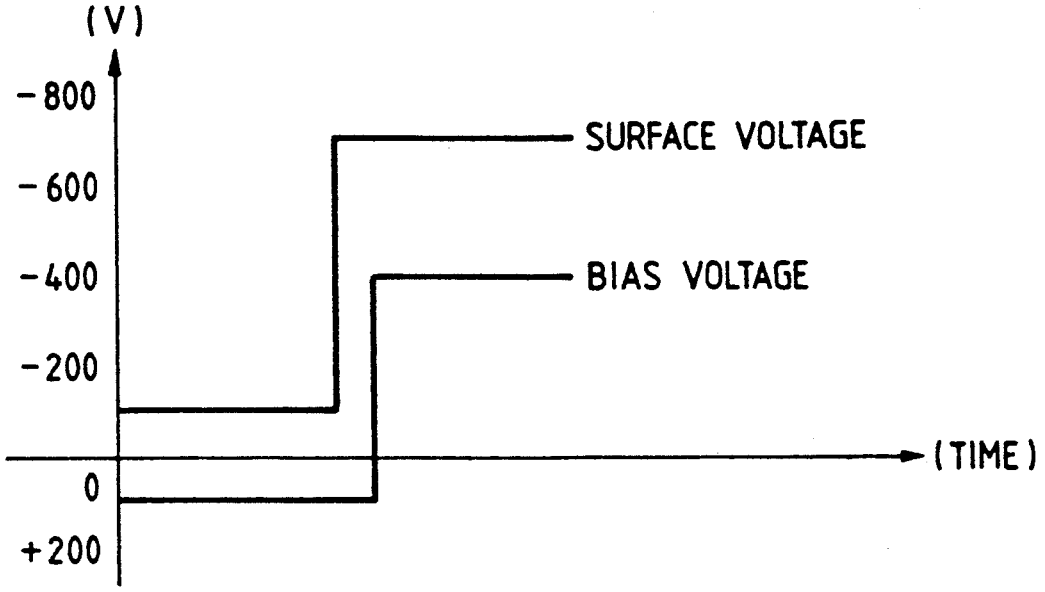
FIGS. 3A and 3B are graphs showing another example of the relationship between the surface voltage of a portion of the photosensitive drum opposite the development means and the bias voltage applied to the development means of the copying machine of FIG. 1.
Figure 3B:
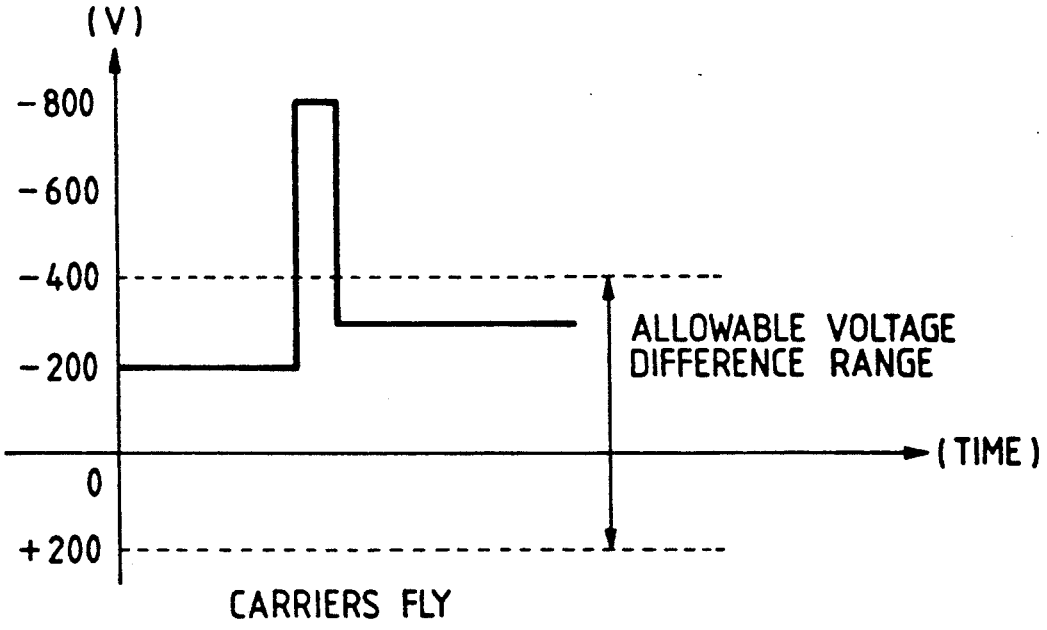
Figure 4:
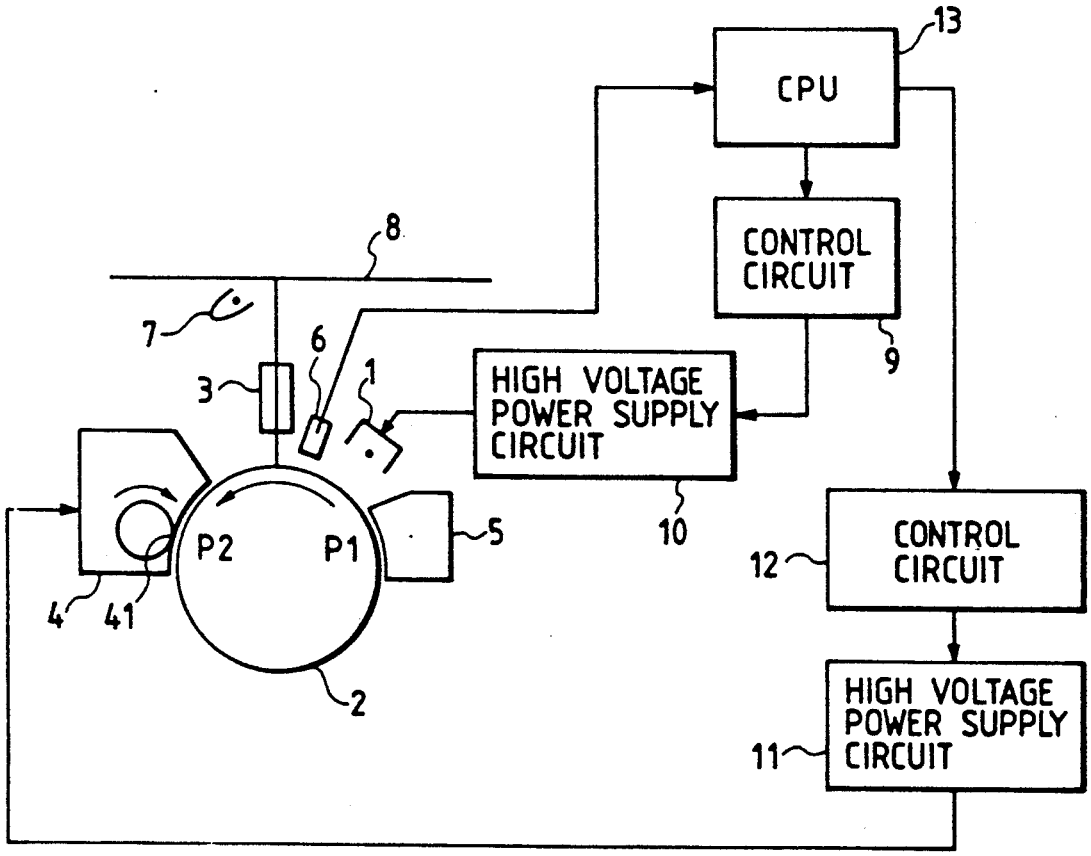
FIG. 4 is a schematic block diagram showing a first embodiment of the inversion development controller according to the present invention.

FIG. 4 is a schematic sectional view showing a main portion of a copying machine utilizing the first embodiment of the inversion development controller according to the present invention. FIG. 4 shows a charger 1 positioned at charging point P1, a surface voltage sensor 6, exposing rod lens array 3 and a developing unit 4. The developing unit 4 includes a development roller 41 positioned at development position P2. These elements and cleaning means 5 for cleaning residual toners are disposed surrounding photosensitive drum 2.

A charger 1 is connected to a high voltage power supply circuit 10 which supplies a voltage of about −800 volts to a charger 1. The high voltage power supply circuit 10 is connected to control circuit 9 which controls the voltage generated by the high voltage power circuit 10.

Developing unit 4 is connected to a high voltage power supply circuit 11 which supplies a voltage to developing unit 4. The high voltage power supply circuit 11 is connected to control circuit 12 which controls the voltage generated by the high voltage supply circuit 11.

A CPU (central processing unit) 13, controls circuits 9 and 12 in accordance with the received output signals of the surface voltage sensor 6. CPU 13 instructs control circuit 9 to gradually change to a first predetermined value the voltage applied by a charger 1 to photosensitive drum 2. CPU 13 further instructs control circuit 12 to gradually change to a second predetermined value the bias voltage applied to development roller 41.

Operation of the embodiment depicted in FIG. 4 will now be described.

Photosensitive drum 2 rotates counterclockwise as shown by the arrow in FIG. 4. A charger 1 charges photosensitive drum 2 with a voltage supplied by high voltage power supply circuit 10. Surface voltage sensor 6 measures the surface voltage of the charged portion of the photosensitive drum 2 and outputs the measurements to CPU 13. Photosensitive drum 2 is then rotated until the charged portion of the photosensitive drum 2 reaches a position opposite that of exposing rod lens array 3. An original placed on contact class 8 is then exposed by light emitted from exposing lamp 7. Light emitted from exposing lamp 7 which reflects from the original travels through exposing rod lens array 3, and forms a latent image on the charged portion of photosensitive drum 2. The charged portion of photosensitive drum 2 containing the latent image is then rotated to a development position P2 opposite that of developing unit 4; and development roller 41. A voltage supplied by high voltage supply circuit 11 is then applied to development roller 41. Toners then fly from development roller 41 to the charged portion of photosensitive drum 2 containing the latent image forming a development image. Thereafter the development image is transformed (not shown), and the residual toners are cleaned by cleaning means 5.

A detailed description of the timing of the surface voltage and bias voltage applications will now be made.

It takes a predetermined time for a portion of photosensitive drum 2 to rotate from charged position P1 to development position P2. For the purposes of illustration, assume it takes 0.4 seconds for a portion of photosensitive drum 2 to travel from charged position P1 to development position P2.

Figure 5:
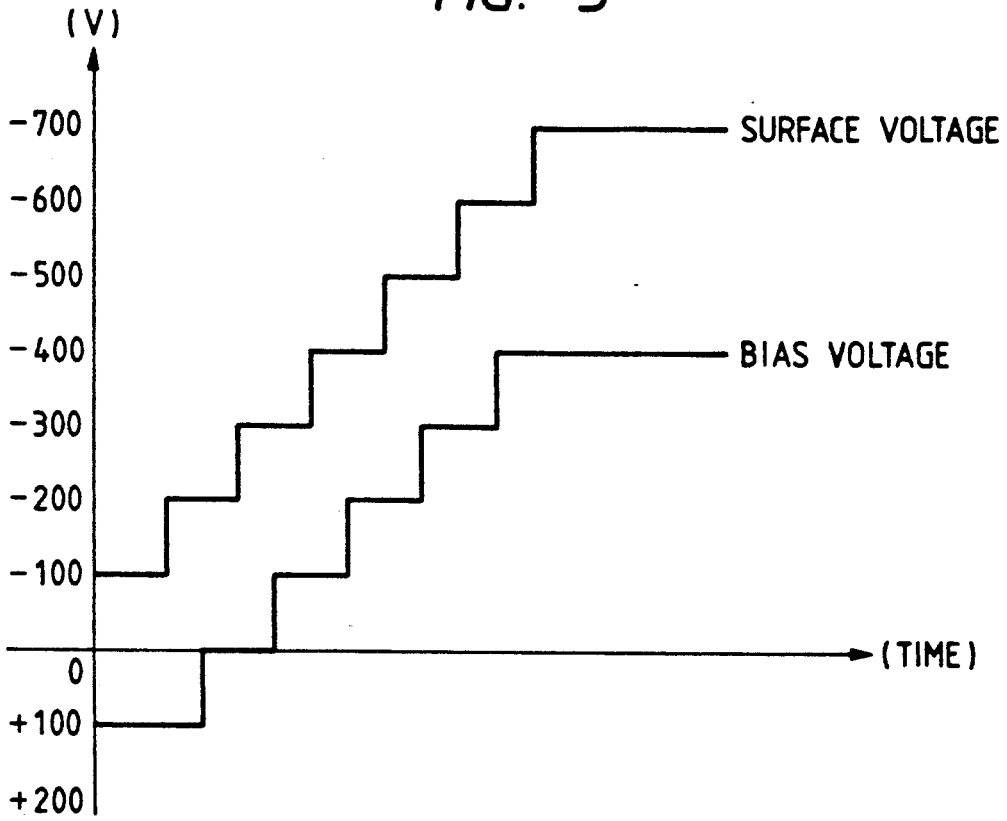
FIG. 5 is a graph showing temporal changes of the surface voltage of a portion of a photosensitive body opposite a development means and the bias voltage applied to the development means of the embodiment of FIG. 4.

CPU 13 drives control circuit 9 to cause high voltage supply circuit 10 to supply a voltage to a charger 1. This voltage is then applied by a charger 1 to photosensitive drum 2. The surface voltage applied by a charger 1 is a stepwise voltage from −100 volts to −700 volts at intervals of −100 volts as shown in FIG. 5. FIG. 5 shows the surface voltage application is shifted in time by 0.4 seconds; in other words, the surface voltage of a portion of photosensitive drum 2 positioned at development point P2. Then, 0.4 seconds after the beginning of the surface voltage application by a charger 1, CPU 13 drives control circuit 12 to cause high voltage supply circuit 11 to supply a bias voltage to developing unit 4. This bias voltage applied to developing unit 4, specifically development roller 41, is a stepwise voltage from +100 volts to −400 volts at intervals at −100 volts. For purposes of illustration assume these stepwise changes are performed at intervals about 0.5 seconds. Therefore, when the portion of photosensitive drum 2 supplied with a voltage of −100 volts has reached the development point P2 the voltage of developing unit 4 is +100 volts. As shown in FIG. 5 the surface voltage on the portion of the photosensitive drum 2 at P2 and the bias voltage of developing unit 4 stepwise changes and the difference between the surface voltage and the bias voltage remains within the allowable voltage difference range as shown in FIG. 6.

Figure 6:
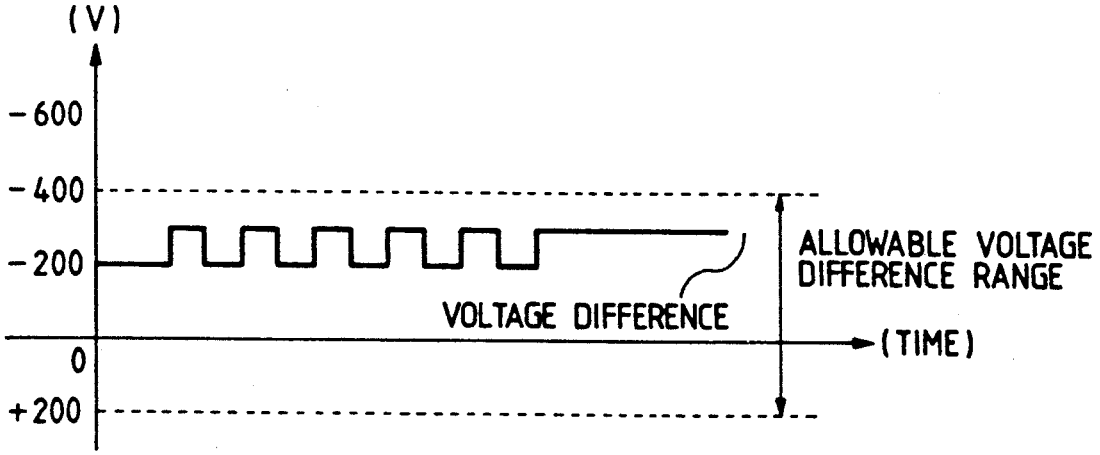
FIG. 6 is a graph showing the voltage difference between the surface voltage and the bias voltage in FIG. 5.

If the timing of the surface voltage or bias voltage application or both is off, a greater voltage difference between the surface voltage of a portion of photosensitive drum at position P2 and the bias voltage than that depicted in FIG. 6 is possible. However, both the surface and bias voltages are gradually changed, thus even if the timing of the surface voltage application or bias voltage application or both are off, the resultant voltage difference does not exceed the allowable voltage difference range. Consequently, toners and carriers are prevented from scattering.

The present invention is not limited to the specific embodiment disclosed. Any means capable of gradually changing the bias voltage and surface voltage to reach a predetermined value may be used.

Moreover, although the gradual change of surface and bias voltages according to the present invention is performed stepwise the gradual change may be performed continuously.

Second Embodiment

Figure 7:
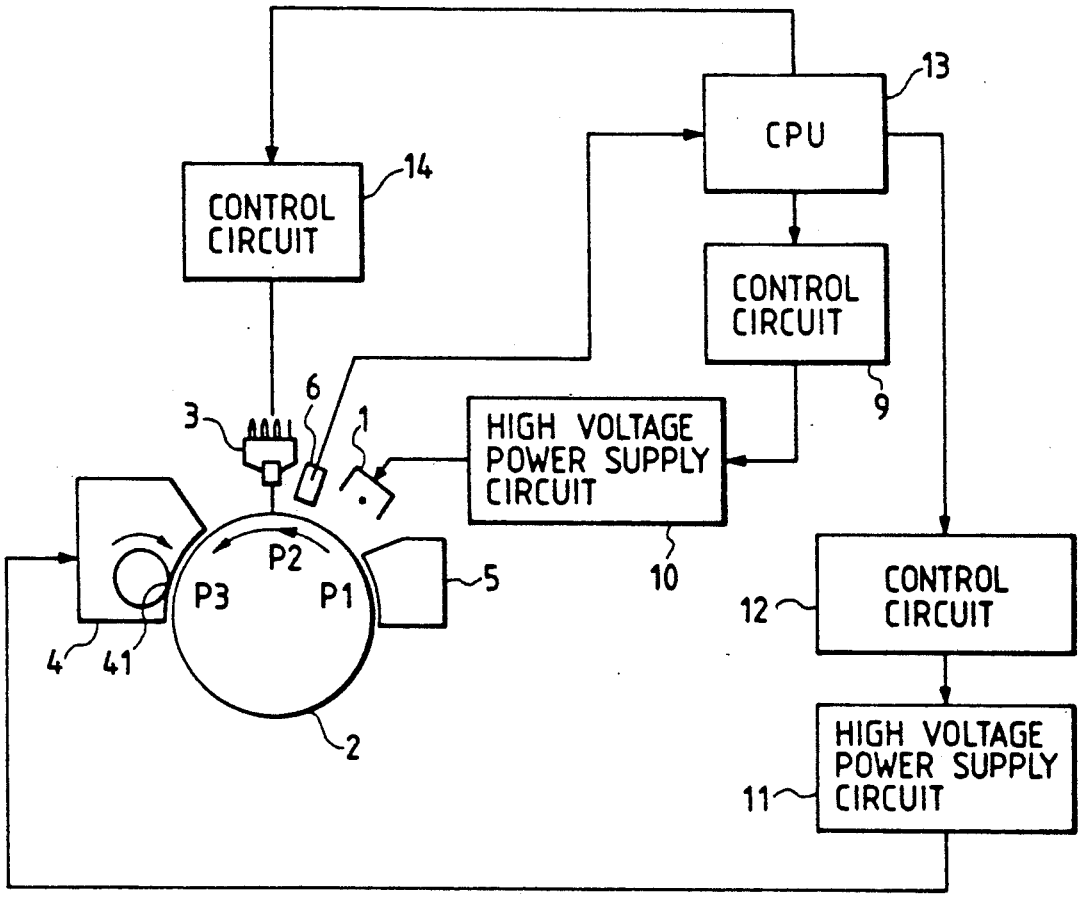
FIG. 7 is a block diagram showing a second embodiment of the inversion development controller according to the present invention.

FIG. 7 is a schematic sectional view showing a main part of a copying machine to which a second embodiment of the inversion development controller according to the present invention is applied. In the second embodiment, elements corresponding to elements which were used in the description of the first embodiment are labeled using the same reference numerals.

In the second embodiment, the exposing rod lens array 3 is connected to a control circuit 14 which controls the quantity of light output by exposing rod lens array 3; the exposure light quantity.

A CPU 13 controls the control circuits 9, 12, and 14 in accordance with the received output signals of surface voltage sensor 6. CPU 13 instructs control circuit 9 to control a charger 1 to apply a high voltage to the surface of photosensitive drum 2. CPU 13 instructs control circuit 14 to control exposing rod lens array 3 to gradually change the exposure light quantity from a predetermined value to zero. CPU 13 further instructs control circuit 12 to gradually change to a predetermined value the bias voltage applied to the development roller 41.

It takes a first predetermined amount of time for a portion of the photosensitive drum 2 to which a surface voltage is applied by a charger 1 at position P1 to rotate and reach the exposure position P2 opposite the exposing rod lens array 3. It takes a second predetermined amount of time for a portion of photosensitive body 2 to rotate from position P2 to position P3 opposite developing unit 4. For purposes of illustration, assume that it takes 0.2 sec for a portion of the photosensitive drum 2 to travel from position P1 to position P2, and 0.4 sec to travel from position P1 to position P3.

Operation of the embodiment depicted in FIG. 7 will now be described.

First CPU 13 drives control circuit 9 causing high voltage supply circuit 10 to supply a voltage to a charger 1 and charge the photosensitive drum 2 to a surface voltage of −700 volts. Next, 0.2 seconds later, CPU 13 drives control circuit 14 to cause exposing rod lens array 3 to emit an exposure light quantity which is stepwise decreased from a predetermined value to zero. As a result, the surface voltage of the charged portion of photosensitive drum 2 at position P2 is increased to −100 volts and stepwise decreases as the exposure light quantity stepwise decreases to zero. Then, 0.2 sec from the beginning of exposure, CPU 13 drives control circuit 12 causing a bias voltage to be applied to the development roller 41 from the high voltage supply circuit 11 stepwise from +100 volts toward a predetermined voltage.

Figure 8:
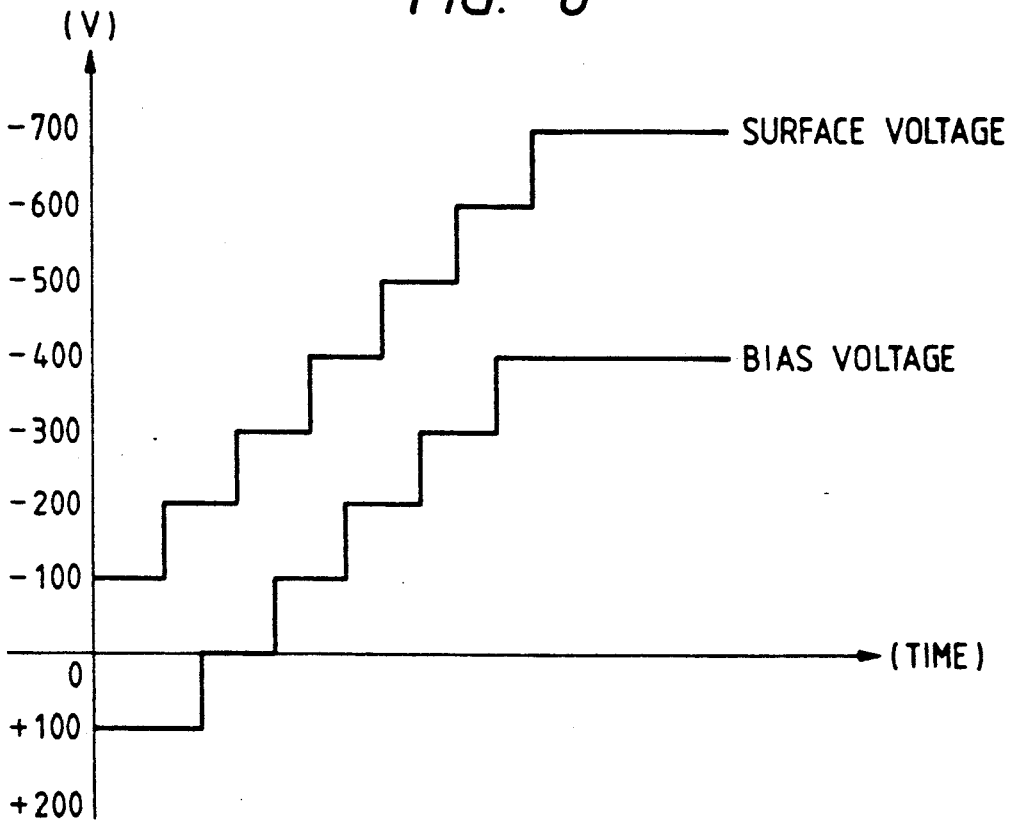
FIG. 8 is a graph showing temporal changes of the surface voltage of a portion of the photosensitive body after exposure opposite the development means and the bias voltage applied to the development means of the embodiment of FIG. 7.

The surface voltage of the photosensitive body at the development position P3 and the bias voltage of the development roller 41 are changed as shown in FIG. 8. The surface voltage of the photosensitive drum 2 is changed from −100 V to −700 V at intervals of −100 V due to the stepwise change of the exposure light quantity. The bias voltage of the development roller 41, is changed from +100 V to −400 V at intervals of −100 V.

Figure 9:
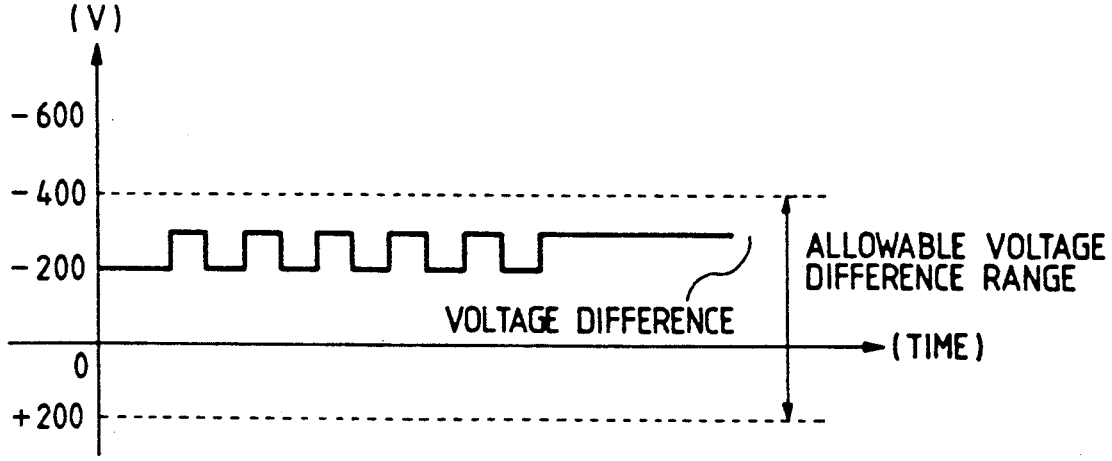
FIG. 9 is a graph showing the voltage difference between the surface voltage and bias voltage in FIG. 8.

As a result, the voltage difference between the surface voltage of the portion of the photosensitive drum 2 at position P3 and the bias voltage of the development roller 41 as shown in FIG. 9 remains within the allowable voltage difference range.

Here, even if the exposure timing of the exposing rod lens array 3 or the timing of the bias voltage application or both are off, the voltage difference between the surface voltage of the portion of the photosensitive drum 2 at position P3 and the bias voltage of development roller 41 does not exceed the allowable voltage difference range because both the exposure light quantity and bias voltage change gradually. Consequently, toners and carriers are prevented from scattering.

The present invention is not limited to the specific embodiment disclosed. Any means capable of gradually changing the bias voltage to a predetermined value may be used. Furthermore, any means capable of gradually changing the exposure light quantity so as to gradually change the surface voltage of the photosensitive drum may be used.

Moreover, although the gradual change of exposure light quantity and bias voltage according to the present invention is performed stepwise the gradual change may be performed continuously.

Moreover, although the present invention is applied to an inversion development apparatus using a two-component developer in the foregoing embodiment, the present invention may be applied to an inversion development apparatus using a one-component developer.

What is claimed is:

1. An inversion development controller for an image forming apparatus comprising:

a charger for applying a surface voltage to a portion of a photosensitive body;

exposing means for forming a latent image on said portion of said photosensitive body;

development means for developing the latent image on said photosensitive body;

bias voltage application means for applying a bias voltage to a development means; and control means for controlling the charger to gradually change the surface voltage of a portion of said photosensitive body to a first predetermined value, and controlling said bias voltage application means to gradually change the bias voltage to a second predetermined value.

2. An inversion development controller as in claim 1, wherein said surface voltage and said bias voltage are gradually changed in a stepwise manner.

3. An inversion development controller of claim 1, wherein said charging control means controls a voltage supply means to supply a voltage to said charger.

4. An inversion development controller as in claim 3, wherein a development control means controls the voltage supplied to said development means by said bias voltage application means; and said control means controls said development control means and said charging control means.

5. An inversion development controller of an image forming device comprising:

a charger for applying a surface voltage to a portion of a photosensitive body;

exposing means for forming a latent image on said portion of said photosensitive body;

light quantity control means for controlling the exposure light quantity of said exposure means to change from a first predetermined value to zero;

development means for developing said latent image;

bias voltage application means for applying a bias voltage to said development means for developing said latent image; and development control means for controlling said bias voltage application means to gradually change said bias voltage to a second predetermined value.

6. An inversion development controller as in claim 5, wherein said exposure light quantity and said bias voltage are gradually changed in a stepwise manner.

7. An inversion development controller as in claim 5, further comprising:

control means for controlling both said development control means and said light quantity control means.

8. An method of inversion development for an image forming apparatus, comprising the steps of:

applying a surface voltage to a portion of a photosensitive body;

forming a latent image on said portion of said photosensitive body;

applying a bias voltage to a development means to develop the latent image on said photosensitive body; and gradually changing the surface voltage of a portion of said photosensitive body to a first predetermined value, and gradually changing said bias voltage to a second predetermined value.

9. A method of inversion development as in claim 8, wherein said surface voltage and said bias voltage are gradually changed in a stepwise manner.

10. A method of inversion development for an image forming device comprising the steps of:

applying a surface voltage to a portion of a photosensitive body;

forming a latent image on said portion of said photosensitive body through light exposure;

controlling the exposure light quantity to change from a first predetermined value to zero;

applying a bias voltage to a development means for developing said latent image; and gradually changing said bias voltage to a second predetermined value.

11. A method of inversion development as in claim 10, wherein said exposure light quantity and said bias voltage are gradually changed in a stepwise manner.

* * * * *